US007571840B2

(12) United States Patent
Chen et al.

(10) Patent No.: US 7,571,840 B2
(45) Date of Patent: Aug. 11, 2009

(54) SAFETY OF NAILING DEVICE

(75) Inventors: Ton-Yi Chen, Taichung (TW); Yuan-Shun Lee, Taichung (TW)

(73) Assignee: Jann Yei Industry Co., Ltd., Taichung (TW)

( * ) Notice: Subject to any disclaimer, the term of this patent is extended or adjusted under 35 U.S.C. 154(b) by 49 days.

(21) Appl. No.: 12/024,122

(22) Filed: Feb. 1, 2008

(65) Prior Publication Data

US 2009/0120991 A1 May 14, 2009

(30) Foreign Application Priority Data

Nov. 12, 2007 (TW) ..... 96142710 A

(51) Int. Cl.
*B27F 7/00* (2006.01)

(52) U.S. Cl. ..... 227/8; 227/10; 227/132; 227/110; 227/119

(58) Field of Classification Search ..... 227/8, 227/10, 132, 110, 119, 120, 121, 123
See application file for complete search history.

(56) References Cited

U.S. PATENT DOCUMENTS 1,927,274 A * 9/1933 Baur ..... 227/146
3,131,397 A * 5/1964 Miller ..... 227/132
3,780,417 A * 12/1973 Reynolds ..... 29/235
3,948,426 A * 4/1976 La Pointe ..... 227/8
6,082,604 A * 7/2000 Dennis ..... 227/8
6,592,014 B2 * 7/2003 Smolinski ..... 227/8
6,908,021 B1 * 6/2005 Wang ..... 227/8
7,318,546 B2 * 1/2008 Segura et al. ..... 227/142
7,413,103 B1 * 8/2008 Ho et al. ..... 227/8
7,458,492 B2 * 12/2008 Terrell et al. ..... 227/8
7,464,843 B2 * 12/2008 Huang ..... 227/8
7,464,845 B2 * 12/2008 Chou ..... 227/132
7,484,647 B2 * 2/2009 Yang ..... 227/8
7,506,787 B2 * 3/2009 Wu et al. ..... 227/8
2002/0108996 A1 * 8/2002 Cornett et al. ..... 227/132
2006/0091175 A1 * 5/2006 Hung et al. ..... 227/8
2007/0267460 A1 * 11/2007 Popowich ..... 227/132
2008/0121678 A1 * 5/2008 Spasov et al. ..... 227/132
2009/0108046 A1 * 4/2009 Huang ..... 227/8

* cited by examiner

*Primary Examiner*—Brian D Nash
(74) *Attorney, Agent, or Firm*—Leong C. Lei

(57) ABSTRACT

A safety is incorporated in a nailing device, which ensures operation safety of the nailing device. The nailing device includes a housing containing a striker plate movable to a ready-to-strike position for subsequently striking a nail. The safety includes a retainer having an inclination engageable with a mated inclination formed on a release plate that is normally biased to partially project out of the housing, so that a stop of the retainer is set at a position to block the striker plate from moving toward the ready-to-striker position. When the nailing device is properly set on a work piece, the release plate is forced by the work piece back into the housing and the retainer is rotated by the camming action between the mated inclination faces so as to move the stop aside to allow the striker plate to move to the ready-to-strike position.

6 Claims, 7 Drawing Sheets

SAFETY OF NAILING DEVICE

BACKGROUND OF THE INVENTION (a) Technical Field of the Invention

The present invention relates to a safety for nailing devices, and in particular to a safety that, unless released, prevents a nail striker plate from being moved to a ready-to-strike position in order to prevent the nailing device from being accidentally triggered to undesirably shoot nails.

(b) Description of the Prior Art

In modern carpentry, a nailing device has been commonly used to function as an automatic nailing too that repeatedly feed out nails. A regular nailing device comprises a housing having a lower portion in which a nail channel is defined for accommodating a strip of nail. A nail feeding device is also provided in association with the nail channel to advance the nail strip. A nail striker plate is arranged inside a housing and movable up and down. When the striker plate is moved upward to a ready-to-strike position, the nails that make up the nail strip are sequentially advanced to a struck position where the nail is forcibly struck out of the housing and into a work piece when the striker plate is triggered.

The conventional nailing device is operated by lifting the striker plate to set the striker plate in a ready-to-strike condition and instantaneously releasing the striker plate to complete the nailing operation. Thus, when the nailing device is not in operation, if the striker plate is undesirably moved to the ready-to-strike position by an accidental actuation of for example an operation handle, then nail may be mistakenly shot and since it is possible that the nailing device is not properly set on a work piece at this time, the mistakenly shot nail may cause damage to operators or other persons staying around or properties. Thus, a safety is often provided. An example is a safety ring that secures, in a releasable manner, the operation handle to the housing to prevent the handle from driving the striker plate to the ready-to-strike position. However, in use of the nailing device, the safety ring must be released to allow the nailing device to be set in a ready-to-strike condition, and therefore inadvertent percussion at the time that the nailing device is not properly set on a work piece may happen, which may hurt the operator or other persons standing nearby by shooting uncontrolled nail.

To cope with such a problem, Taiwan Patent No. I281432 discloses a nailing device comprising a housing in which a safety bar is movably arranged in such a way that the safety bar is normally projecting out of a bottom of the housing. The safety bar functions to prevent an engaging portion formed on a handle from engaging an opening defined in a striker plate. When the nailing device is properly set on a work piece, the safety bar is forced into the housing, allowing the handle to engage the striker plate for setting the nailing device in a ready-to-strike condition. As such, inadvertent percussion of the nailing device can be avoided.

The known device uses a biasing torque provided by a torsion spring to disengage the engaging portion of the handle from the opening of the striker plate in order to realize prevention of inadvertent percussion. However, when the operator of the nailing device applies a force that exceeds the spring force, the engaging portion of the handle may also get back into engagement with the opening of the striker plate to cause undesired percussion. Apparently, the known device is not capable to fully eliminate the potential risk of inadvertent percussion.

In view of the above discussed issue, the present inventor has engaged in researches in the related fields, attempting to ensure an improvement that secures the operation safety of a nailing device by incorporating a novel safety to eventually and completely overcome the problem associated with inadvertent percussion of the conventional nailing devices.

SUMMARY OF THE INVENTION

The primary purpose of the present invention is to provide a safety for a nailing device that, when the nailing device is not properly set on a surface of a work piece, prevents nail from being mistakenly shot to thereby secure the operation safety of the nailing device.

The objective can be realized with the following construction of nailing device, which comprises a housing, a striker plate that is selectively movable to a ready-to-strike position, and a safety that selectively prevents the striker plate from being moved to the ready-to-strike position, wherein the safety comprising a release plate and a rotatable retainer.

The release plate is movably mounted in the housing in front of the striker plate. The release plate has an upper end forming a first inclination face. A recoiling spring is arranged above and acting against the upper end of the release plate to bias the release plate downward from a retracted position where the release plate is completely accommodated in the housing to a projecting position where a lower end of the release plate projects beyond a bottom of the housing.

The rotatable retainer is rotatably mounted to the housing and located above the release plate and the striker plate. The retainer comprises at least one stop that is selectively set at a predetermined position to prevent the movement of the striker plate toward the ready-to strike position and a second inclination face engageable with the first inclination face of the release plate so that the retainer is normally set a location where the stop is located at the predetermined position to prevent the movement of the striker plate toward the ready-to-strike position.

With such an arrangement, the safety of the present invention comprises a rotatable retainer that effectively prevents/allows the striker plate to be moved to the ready-to-strike position in accordance with whether the release plate is projecting out of the housing or is retracted back into the housing. Thus, unless the nailing device is properly set on a work piece, which forces the release plate back into the housing, the striker plate cannot be moved to the ready-to-strike position, whereby mistakenly shooting nails when the nailing device is not in use can be eliminated. In this way, operation safety of the nailing device during regular uses can be secured.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
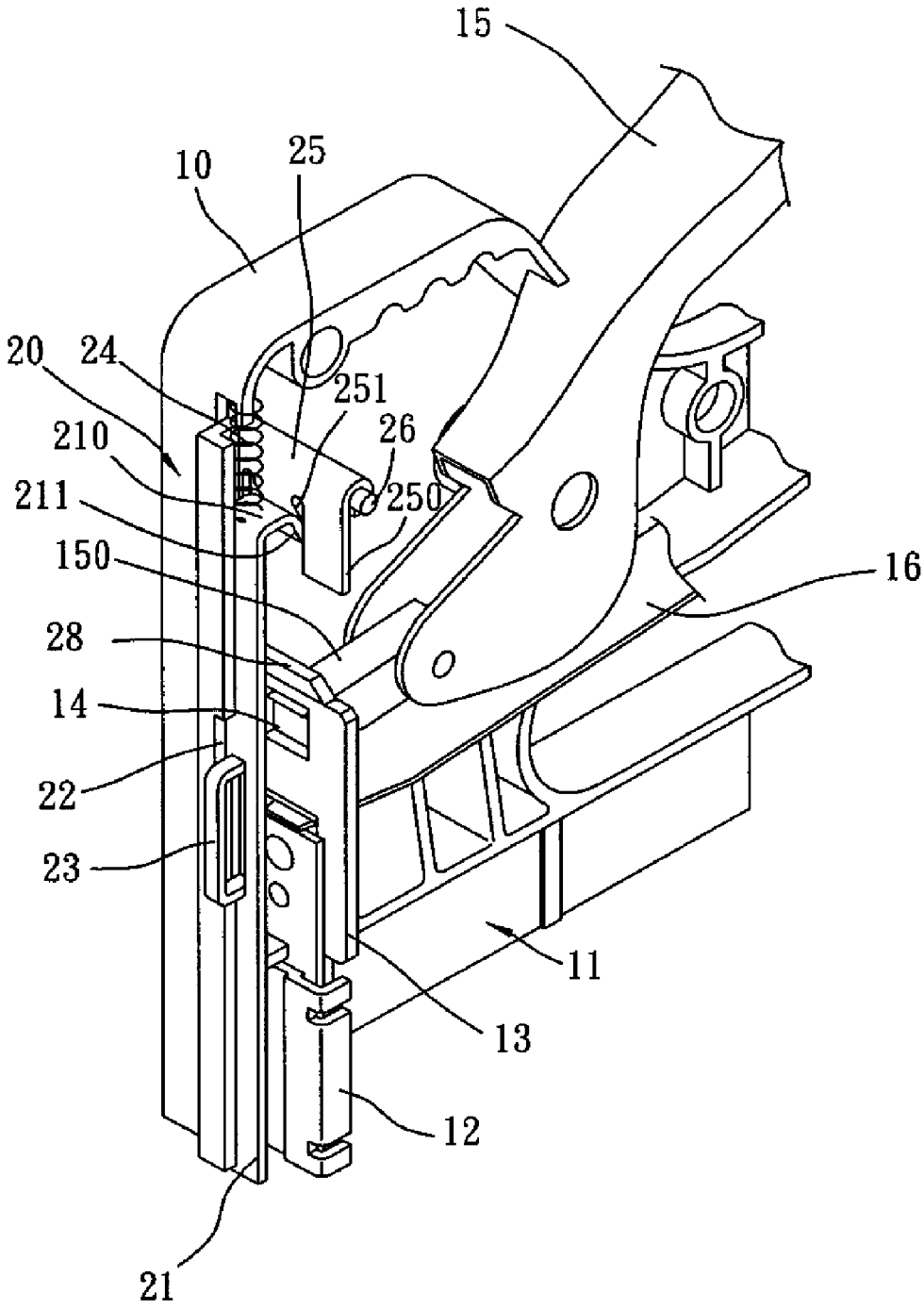
FIG. 1 is a perspective view of a portion of a nailing device of which a housing is broken to illustrate a safety constructed in accordance with the present invention.
Figure 2:
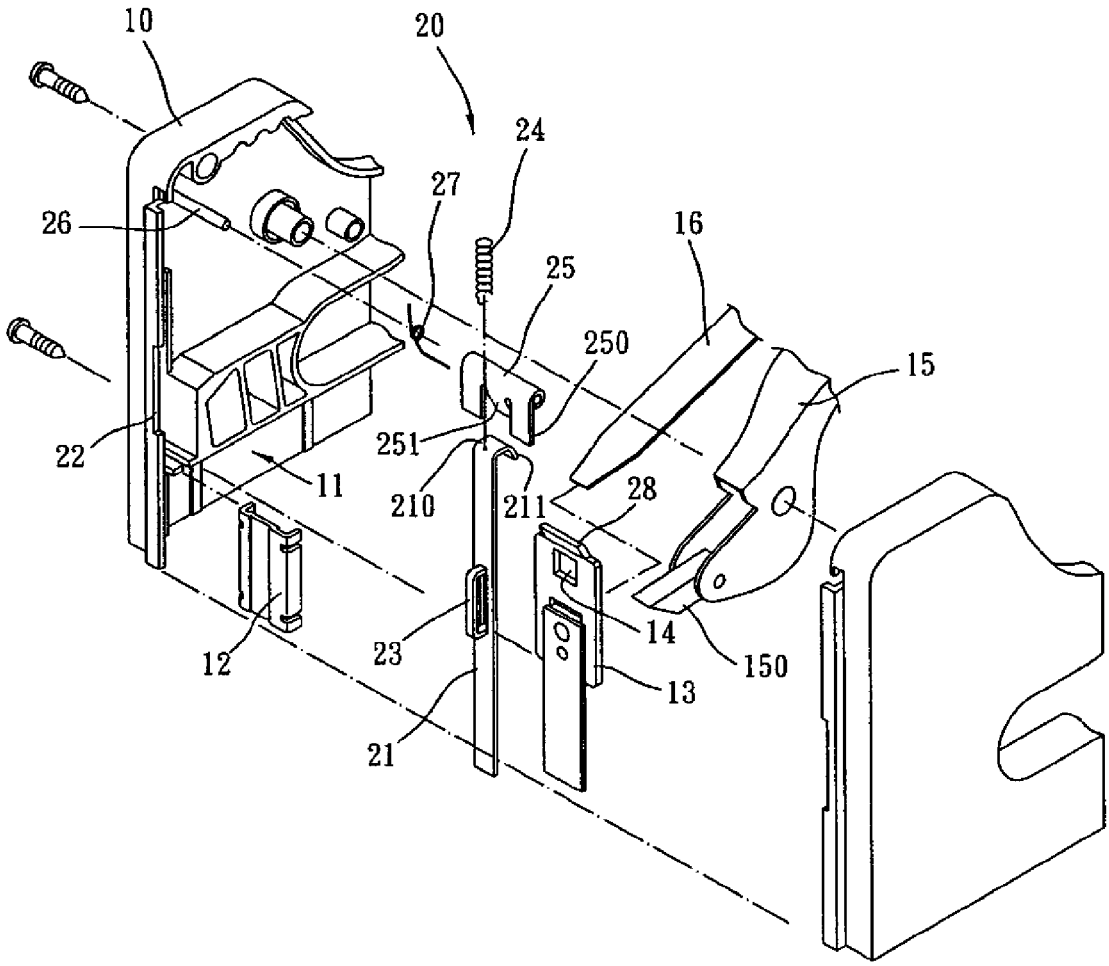
FIG. 2 is an exploded view of the portion of the nailing device in accordance with the present invention, illustrating the spatial relationship among the parts thereof.
Figure 5:
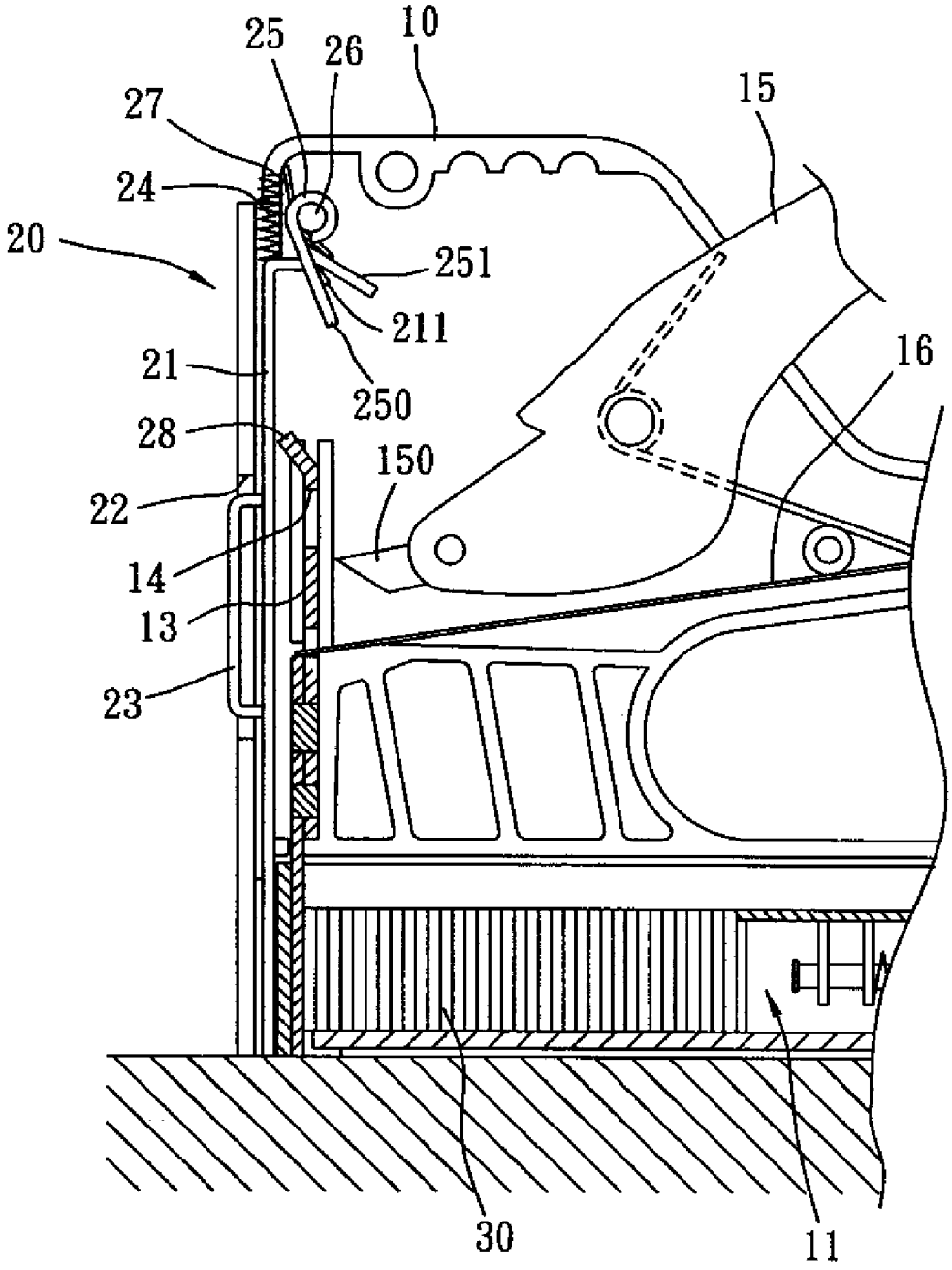
FIG. 5 is a cross-sectional view illustrating the condition when the safety of the nailing device is released by properly setting the nailing device on a work piece.
Figure 6:
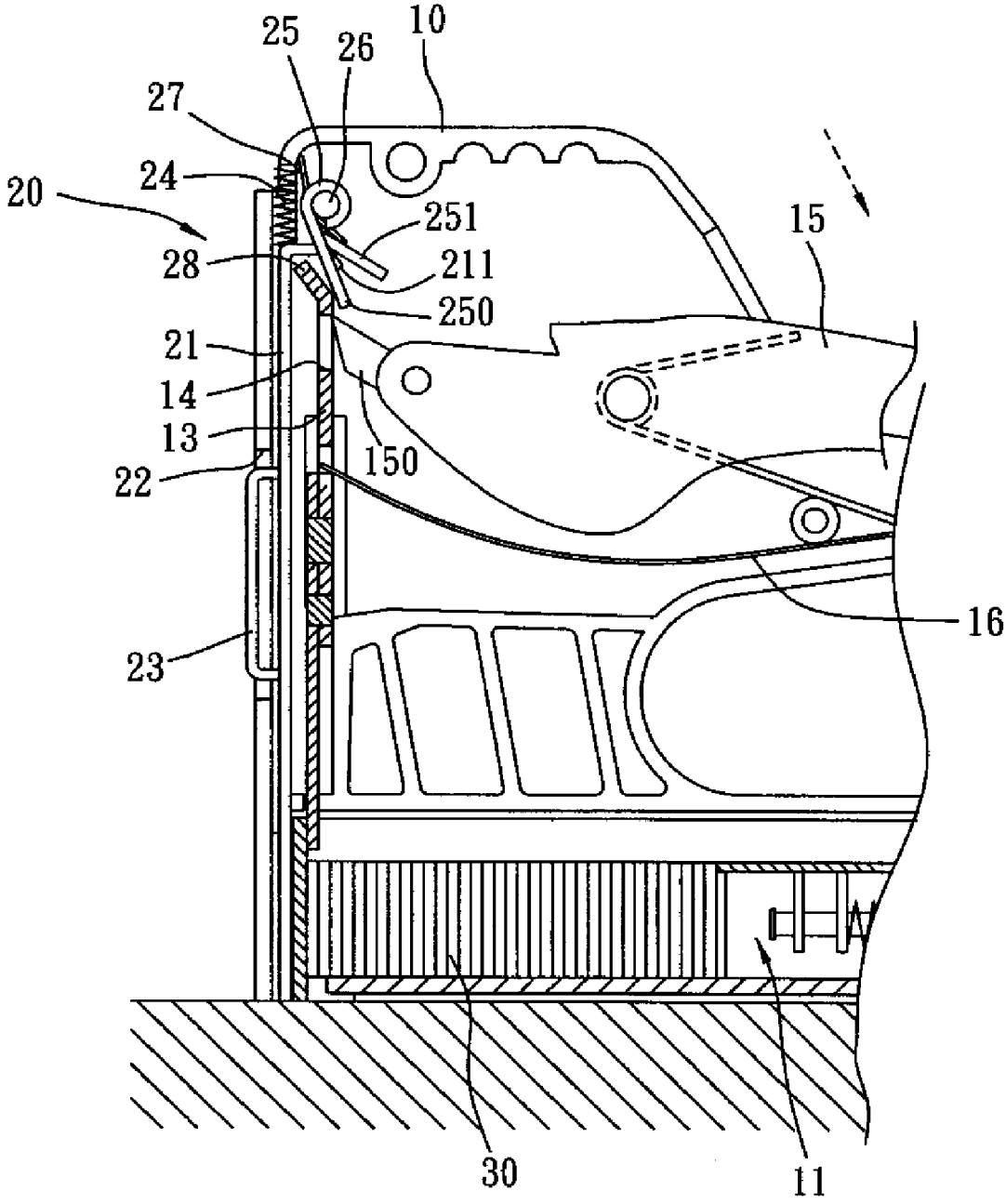
FIG. 6 is a cross-sectional view illustrating the condition when the safety of the nailing device is released and a handle of the nailing device is operated to drive the striker plate to the ready-to-strike position.
Figure 7:
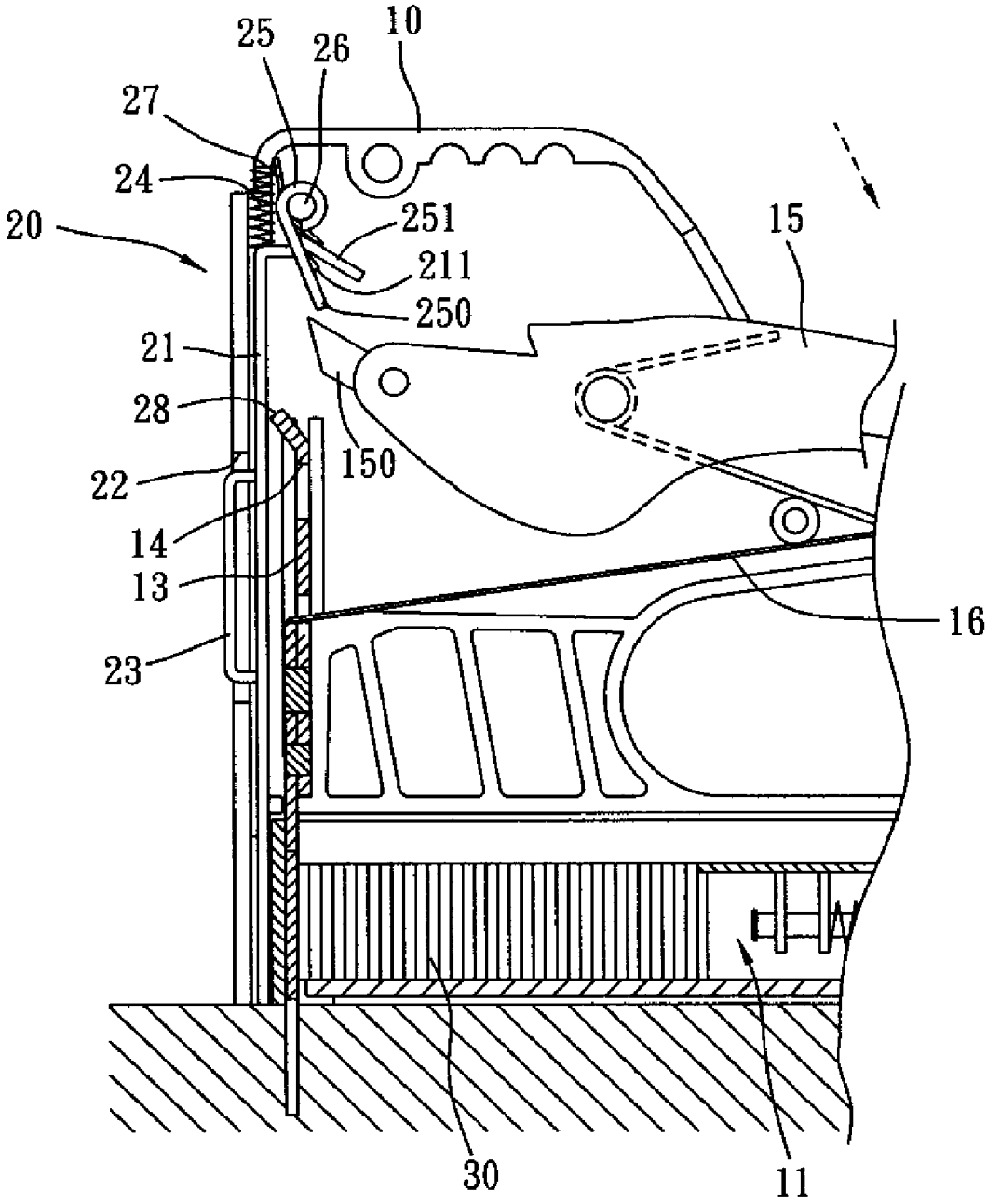
FIG. 7 is a cross-sectional view illustrating the condition when the striker plate is forcibly driven downward by a spring plate to strike a nail into the work piece.

With reference to the drawings, and in particular to FIGS. 1 and 2, a safety is provided for preventing a nailing device from being accidentally triggered to shoot a nail in an unexpected manner. As shown in the drawings, the nailing device in which the safety in accordance with the present invention is embodied comprises a housing 10 having a lower portion in which a nail channel 11 that receives a strip of nails 30 is formed. In a front portion of the housing 10, a rail 12 is formed above the nail channel 11 for guiding the movement of a nail striker plate 13 in a manner of being substantially perpendicular to and intersecting the nail channel 11. The striker plate 13 forms, in an upper portion thereof, a driving hole 14. A handle 15 is pivoted to the housing 10. The handle 15 is provided, at an end thereof offsetting from the pivotal connection, with a driving member 150 that engages the driving hole 14 of the striker plate 13 for selectively driving the striker plate 13 upward to a ready-to-strike position above the nails 30, as shown in FIGS. 5 and 6. The housing 10 is further provided therein a spring plate 16, which is caused to generate a returning force by the upward movement of the striker plate 13 to the ready-to-strike position. When an operator actuates the handle 15, for example depressing the handle 15 in the embodiment illustrated, to drive the striker plate 13 to and ready-to-strike position and then release the striker plate 13, the striker plate 13 may instantaneously strike the nails 30 located in the nail channel 11 out of the housing 10. The safety constructed in accordance with the present invention, which is generally designated with reference numeral 20, is arranged in the housing 10 and above the striker plate 13 to selectively impose constraint to the movement of the striker plate 13 toward the ready-to-strike position.

In the following description, a preferred embodiment of the safety 20 constructed in accordance with the present invention will be illustrated with reference to FIGS. 1-3. The safety 20 comprises a release plate 21, a recoiling spring 24, and a rotatable retainer 25. The release plate 21 is slidably arranged in the housing 10 in front of striker plate 13. Mated guiding means 22, 23 are provided between the housing 10 and the release plate 21 to allow limited movement of the release plate 21 with respect to the housing 10 between a projecting position, where a lower end of the release plate 21 projects beyond a bottom of the housing 10, and a retracted position, where the release plate 21 is completely retracted back into the housing 10. In the embodiment illustrated, the guiding means 22, 23 are, respectively, an elongated slot defined in a housing wall and a projection formed on the release plate 21. The release plate 21 has an upper end that is bent to form a substantially horizontal support section 210 for stably supporting and retaining the recoiling spring 24 thereon. The support section 210 has a free end, which is further bent downward to form an inclination guide face 211 that is sloped in a direction away from the release plate 21. The inclination guide face 21 is engageable with a mated inclination guide face 251 that is formed on the rotatable retainer 25 to ensure a camming contact therebetween so that when the nailing device is positioned on a surface of a work piece, the release plate 21, due to the lower end thereof being forced from the projecting position to the retracted position, is moved upward to cause rotation (or angular displacement) of the retainer 25 about a pivot 26 to a predetermined angle by means of the camming contact. Further, with the recoiling spring 24 arranged above the release plate 21, the release plate is biased by the recoiling spring 24 and is thus allowed to automatically return from the retracted position to the projecting position, whereby the lower end thereof projecting beyond the bottom of the housing 10.

Besides the inclination guide face 251 that extends downward and outward to be engageable with the inclination guide face 211 of the release plate 21, the rotatable retainer 25, which is rotatably mounted to the housing 10 by the pivot 26 at a location above the release plate 21 and the striker plate 13, comprises one or more stops 250 that prevent the upward movement of the striker plate 13 toward the ready-to-strike position. A torsion spring 27 is arranged between the rotatable retainer 25 and the housing 10 to normally set the retainer 25 at a position where the stops 250 can prevent the striker plate 13 to move upward toward the ready-to-strike position, as demonstrated in FIGS. 3 and 4. In this respect, the release plate 13 is provided with an engaging section 28 that is engageable with the stops 250 of the retainer 25 so that the release plate 13 is subjected to the constraint imposed by the retainer 25 in a non-operating condition.

With such an arrangement, when the nailing device is not set in a normal operation condition where the nailing device is positioned against for example a work piece, the striker plate 13 cannot be lifted by operation or actuation of the handle 15 to the ready-to-strike position for percussion. Thus, accidental or undesired triggering to shoot nails can be prevented and accordingly, a safety for a nailing device is realized.

The practical use of the nailing device of the present invention will be illustrated with reference to FIGS. 3 and 4. When the nailing device is not properly set on a surface of a work piece, the release plate 21 of the safety 20 is biased by the recoiling spring 24 to have the lower end thereof projecting beyond the bottom of the housing 10. Consequently, the rotatable retainer 25 is not subject to any driving by the release plate 21 and is thus maintained by the torsion spring 27 at the position where the stops 250 of the retainer 25 are set corresponding to and engageable with the engaging section 28 of the striker plate 13. Under this condition, when an operator attempts to actuate or depress the handle 15, the driving member 150 of the handle 15 is initially brought into engagement with the driving hole 14 of the striker plate 13 to move the striker plate 13 toward the ready-to-strike position. Such a movement of the striker plate 13, however, is stopped by the stops 250 of the retainer 25 when the engaging section 28 of the striker 13 gets into contact with the stops 250 during the course of the upward movement of the striker plate 13. The retainer 25 is maintained in position by the engagement thereof with the release plate 13, which is in turn kept in position by the recoiling spring 24, so that the retainer 25, even subjected to a torque induced by a force applied on the steps 250 by the engaging section 28 of the striker plate 13, is not rotated and maintains in position to block the upward movement of the striker plate 13, demonstrating a secured condition of the safety 20. As a result, the striker plate 13 is prevented from further movement to the ready-to-strike position as shown in FIG. 4. Thus, the striker plate 13 cannot proceed with the nail striking operation to strike nails 30 out of nailing device in a condition where the nailing device is not properly set on a surface of a work piece. Operation safety of the nailing device can thus be secured.

Figure 3:
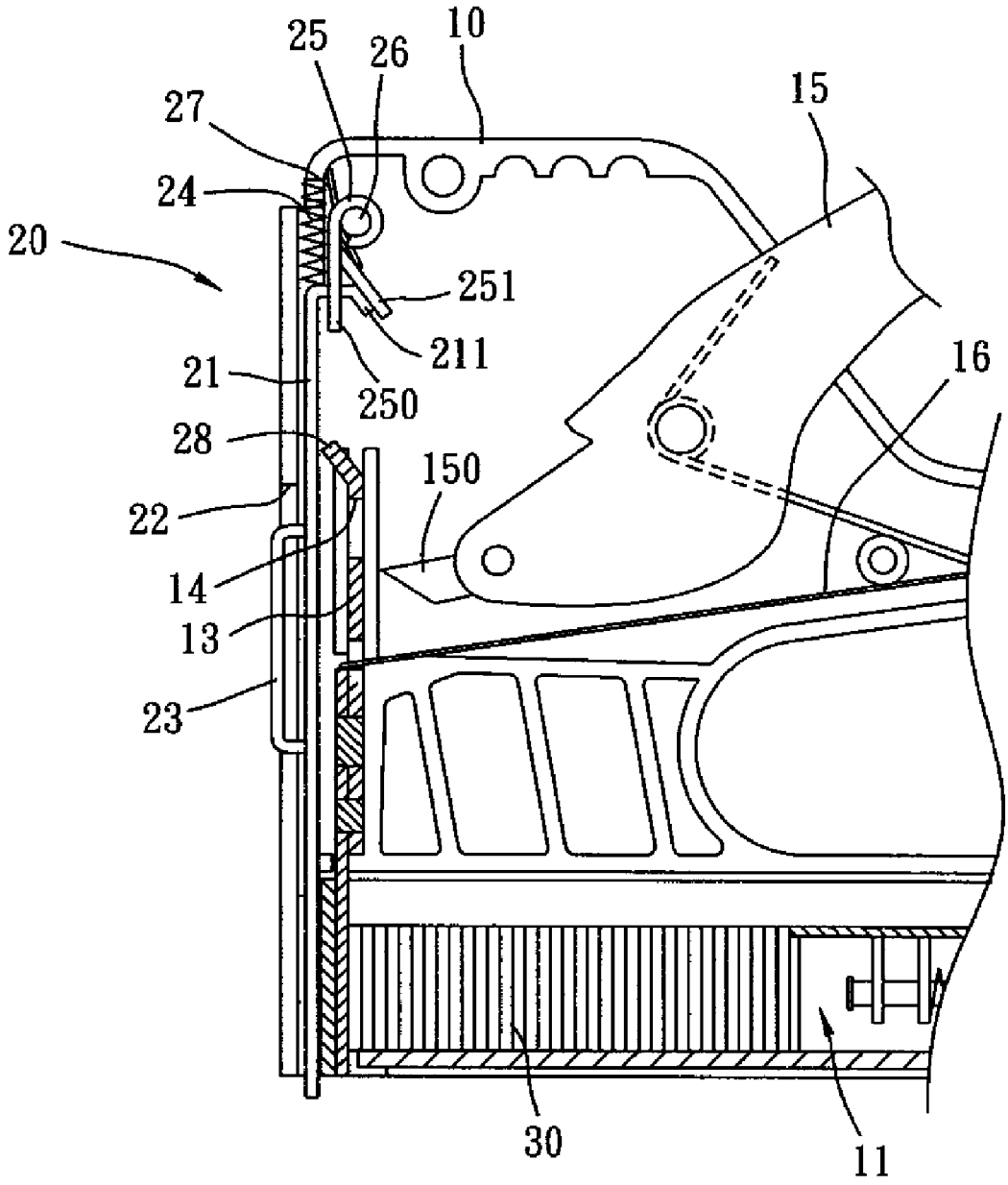
FIG. 3 is a cross-sectional view of the nailing device incorporating the safety of the present invention.
Figure 4:
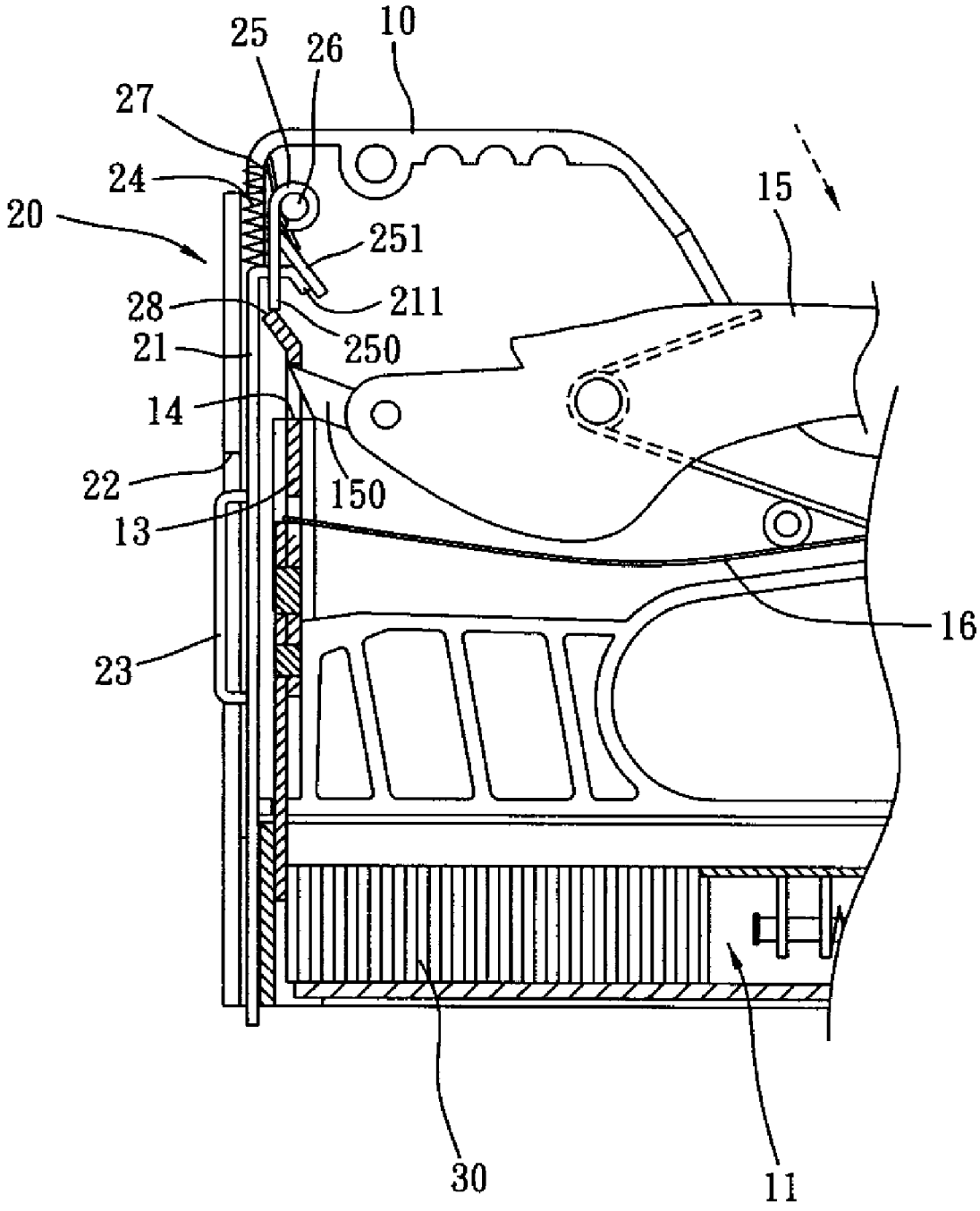
FIG. 4 is a cross-sectional illustrating the condition when the safety of the nailing device is not released so as to prevent a striker plate from being moved to a ready-to-strike position.

On the other hand, when the operator needs to perform nailing operation with the nailing device, as shown in FIGS. 3 and 5-7, the operator positions the nailing device against a surface of a work piece on which the nailing operation is to be carried out, as shown in FIG. 5, to retract the release plate 13 of the safety 20 back into the housing 10 and simultaneously compress the recoiling spring 24 to generate a spring force. When the release plate 21 moves upward, the camming action between the inclination guide faces 211, 251 causes the rotatable retainer 25 to rotate in such a way that the stops 250 of the retainer 25 are shifted aside with respect to the engaging section 28 of the striker plate 13, as shown in FIG. 5, demonstrating a released or open condition of the safety 20. Under this condition, the actuation or depression of the handle 15 by the operator brings the driving member 150 into engagement with the driving hole 14 of the striker plate 13 and drives the striker plate 13 upward to the ready-to-strike position, FIG. 6. At the same time, the spring plate 16 is upward deflected to generate the returning force. Once the striker plate 13 is sufficiently moved upward to the ready-to-strike position, the driving member 150 of the handle 15 is allowed to disengage from the driving hole 14 of the striker plate 13 and the striker plate 13 is released so that the striker plate 13, under the action of the returning force provided by the spring plate 16, is instantaneously driven downward to strike the nail 30 located therebelow into the work piece to complete the nailing operation. After that, with the nailing device moved off the work piece, the release plate 21 and the retainer 25 are respectively acted upon by the spring forces of springs 24, 27 to return to their original positions corresponding to the secured condition, as shown in FIG. 3, to get ready for next nailing operation.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

We claim:

1. A safety adapted to be incorporated in a nailing device that comprises a housing containing therein a striker plate that is movable to a ready-to-strike position from which the striker plate is selectively released to strike a nail out of the housing, the safety being mounted to the housing to selectively prevent the striker plate from being moved to the ready-to-strike position, and the safety comprising:

a release plate movably mounted in the housing in front of the striker plate, the release plate having an upper end forming a first inclination face, a recoiling spring being arranged above and acting against the upper end of the release plate to bias the release plate downward from a retracted position where the release plate is completely accommodated in the housing to a projecting position where a lower end of the release plate projects beyond a bottom of the housing; and a rotatable retainer rotatably mounted to the housing and located above the release plate and the striker plate, the retainer comprising at least one stop that is selectively set at a predetermined position to prevent the movement of the striker plate toward the ready-to strike position and a second inclination face engageable with the first inclination face of the release plate so that the retainer is normally set at a location where the stop is located at the predetermined position to prevent the movement of the striker plate toward the ready-to-strike position.

2. The safety as claimed in claim 1, wherein guiding means is provided between the housing and the release plate to allow limited movement of the release plate with respect to the housing between the retracted position and the projecting position.

3. The safety as claimed in claim 2, wherein the guiding means comprises an elongated slot defined in the housing and a projection formed on the release plate.

4. The safety as claimed in claim 1, wherein the upper end of the release plate forms a support section on which the recoiling spring is mounted.

5. The safety as claim in claim 1, wherein the rotatable retainer is rotatably mounted to the housing by a pivot.

6. The safety as claimed in claim 1, wherein a torsion spring is arranged between the rotatable retainer and the housing to normally set the retainer in such a way that the stop is normally set at the predetermined position to prevent the movement of the striker plate toward the ready-to-strike position.

* * * * *